US007404892B2

(12) United States Patent
Shaw et al.

(10) Patent No.: US 7,404,892 B2
(45) Date of Patent: Jul. 29, 2008

(54) STORM WATER CATCH BASIN FILTER COMPRISING AN ANTI-MICROBIAL AGENT

(75) Inventors: Mark D. Shaw, Ponte Vedra Beach, FL (US); J. Tad Heyman, Atlantic Beach, FL (US); Laurence M. Bierce, Steinhatchee, FL (US)

(73) Assignee: Ultra Tech International, Inc., Jacksonville, FL (US)

( * ) Notice: Subject to any disclaimer, the term of this patent is extended or adjusted under 35 U.S.C. 154(b) by 57 days.

(21) Appl. No.: 11/488,218

(22) Filed: Jul. 18, 2006

(65) Prior Publication Data

US 2007/0012606 A1 Jan. 18, 2007

Related U.S. Application Data

(60) Provisional application No. 60/700,279, filed on Jul. 18, 2005.

(51) Int. Cl.
*E03F 5/06* (2006.01)

(52) U.S. Cl. ..... 210/163; 210/170.03; 210/206; 210/501

(58) Field of Classification Search ..... 210/163, 210/164, 170.03, 205, 206, 266, 474, 501, 210/764
See application file for complete search history.

(56) References Cited

U.S. PATENT DOCUMENTS 3,756,410 A * 9/1973 Moody et al. ..... 210/242.1
4,419,232 A * 12/1983 Arntyr et al. ..... 210/164
5,264,134 A 11/1993 McCamy
5,372,714 A 12/1994 Logue, Jr.
5,575,925 A 11/1996 Logue, Jr.
5,954,869 A 9/1999 Elfersy et al.
6,270,663 B1 * 8/2001 Happel ..... 210/170.03
6,537,446 B1 * 3/2003 Sanguinetti ..... 210/163
6,551,023 B2 * 4/2003 Allard ..... 210/164
6,666,966 B1 * 12/2003 Schluttig ..... 210/163
6,712,976 B2 3/2004 Manzone
2005/0218049 A1 * 10/2005 Happel ..... 210/163
2005/0279709 A1 * 12/2005 Peters et al. ..... 210/163

* cited by examiner

*Primary Examiner*—Christopher Upton
(74) *Attorney, Agent, or Firm*—Thomas C. Saitta

(57) ABSTRACT

A combination filtration and anti-microbial catch basin filter disposed in a catch basin of a storm water system such that, in addition to removing particulate matter and other contaminants, the concentration of bacteria in storm water that remains resident in the sump of a catch basin after a storm event is severely reduced or eradicated. The catch basin filter comprises a filtration bag depending from the opening such that water must pass through the bag and a plurality of strips or similar members depending from the filtration bag, the length of the strips being such that they remain in contact with water resident in the bottom of the catch basin. In an alternative embodiment, the device comprises a floatation member with filtering means and anti-microbial strips depending therefrom.

25 Claims, 2 Drawing Sheets

STORM WATER CATCH BASIN FILTER COMPRISING AN ANTI-MICROBIAL AGENT

This application claims the benefit of U.S. Provisional Patent Application Ser. No. 60/700,279, filed Jul. 18, 2005.

BACKGROUND OF THE INVENTION

This invention relates generally to the field of storm water drainage systems, and in particular filtration of storm water run-off as captured, controlled and transported by storm water drainage systems. More particularly, the invention relates to the field of means to filter storm water or surface water run-off to remove hydrocarbons, organic liquids and other contaminants and particulate matter, as well to eradicate bacteria in the storm water run-off. Even more particularly, the invention relates to devices known as catch basin filters that are disposed in catch basins beneath storm water drain grates or curb inlets, typically found adjacent to paved roadways or parking lots.

As a result of society's high level of use of products containing hydrocarbons, organic liquids, phosphates, nitrates, heavy metals and other environmentally hazardous materials and chemicals, it is not uncommon for such components to be flushed in significant amounts into storm water drainage systems. It is therefore necessary to provide means and methods to remove such contaminants from the storm water prior to discharge of the storm water from the storm water system. In a common approach filtration means capable of capturing the contaminants are disposed at the ingress points of the storm water system, i.e., filter means are positioned in the storm drains such that the contaminants are immediately captured and storm water passing into the storm water drainage system is relatively contaminant-free. In another method, filtration means are positioned at the points of exit of the storm water system, such that the contaminants are removed prior to discharge into the environment. A typical storm drain comprises a surface opening covered by a grate, a curb inlet, or a combination of the two, where the surface opening leads directly into a catch basin, usually of a rectangular or cylindrical shape, that has a sump that allows particulates to settle. An outlet pipe connects to the catch basin above the sump and directs the storm water to a point of treatment or discharge.

Another problem inherent in storm water discharge is microbial contamination. Significant microbial contamination of discharge water results from the fact that storm water systems comprise vast networks of storm drains, conduits, collectors and the like, and all storm water run-off entering a storm water system does not immediately pass through the system. Instead there are large numbers of areas where the storm water remains resident in the system for extended periods of time. For example, the outlet pipes at the base of storm drains is typically connected to the catch basin several inches above the bottom of the basin to create a sump area to entrap sediments and other solid matter. This results in several inches of water that remaining trapped in the bottom or sump of each catch basin after a storm. This resident water is a prime breeding ground for bacteria, and over time the bacteria in the catch basin sumps multiply exponentially. When the next storm occurs the resident water in the catch basins is flushed and the bacterial concentration discharging from the storm system may exceed safe limits. In addition, the bacterial contamination of the resident sump water can result in odor problems.

Providing anti-microbial agents as a component of suspended filtration media at the ingress points of the storm system, i.e., the storm grates or curb inlets, such that the inflowing water contacts the anti-microbial agents does not solve this problem, as the amount of time that the bacteria is in contact with the anti-microbial agents in these pass-through catch basin filters is extremely short, and thus the effectiveness of the anti-microbial action is very limited if not completely ineffective. Because the anti-microbial agents are positioned above the sump area, they have no effect on bacterial growth in the resident water.

It is an object of this invention therefore, to provide a means for effectively reducing the bacterial concentration in storm water discharge. This is accomplished by providing a combination filtration and anti-microbial medium that, in addition to removing particulate matter from the storm water inflow, effectively reduces the concentration of bacteria in storm water that remains resident in sump areas at the bottom of a catch basin. The combination filtration and anti-microbial medium is at least partially disposed in the resident water at the bottom of the catch basin rather than being positioned merely as a pass-through filter, thereby increasing the contact time between the anti-microbial agents and the bacteria such that large amounts of bacteria are eradicated and explosive bacterial growth within the sump areas is precluded. It is a further object to increase the effective life of the filtration media by reducing the growth of bacteria, mold, algae and the like on the filtration media itself.

SUMMARY OF THE INVENTION

Bacterial discharge from a storm water system is eradicated or severely reduced in concentration by providing a combination filtration and anti-microbial device within the catch basins of the storm water system such that, in addition to removing particulate matter and other contaminants, the concentration of bacteria in storm water that remains resident in sump areas after a storm event is severely reduced or eradicated. The combination filtration and anti-microbial medium is disposed at least partially in the resident water within the sumps of the system rather than being positioned solely as a pass-through filter, thereby increasing the contact time between the anti-microbial agents and the bacteria such that large amounts of bacteria are eradicated and explosive bacterial growth within the sump areas is precluded prior to such bacteria being flushed from the system during the next storm event. The anti-microbial agent is adhered to, combined with, or impregnated in the filter material, or disposed as blocks, granules, beads or the like retained by pockets in the filtration fabric, or otherwise joined to or retained by the filtration media.

The invention comprises a catch basin filter similar in construction to known catch basin filters, in that the device comprises a pass-through filter member, preferably of a bag or sack-like structure having an open top and a closed bottom, that is positioned across the surface opening or hangs within the catch basin, such that storm water entering the surface opening passes through the filter member for filtering of contaminant matter. Attached to the bottom of the filtration bag are one or more depending members of sufficient length to reach to or near the bottom of the catch basin sump. The depending members are carriers for an anti-microbial agent. The ends of the depending members may be weighted, tethered or otherwise secured such that they will extend beneath the surface of the resident water. Preferably, the depending members are composed of a filtration medium that removes hydrocarbons, organic liquids and other contaminants from the resident water, but the depending members may be composed of any suitable matrix or carrier material to support the anti-microbial agent.

In an alternative embodiment, the catch basin filter comprises a floating member surrounding a bag-like filter member or a generally horizontally disposed pass-through filter sheet member, and one or more depending members joined to the floating member, with the depending members being the carriers for an anti-microbial agent.

DETAILED DESCRIPTION OF THE INVENTION

Figure 1:
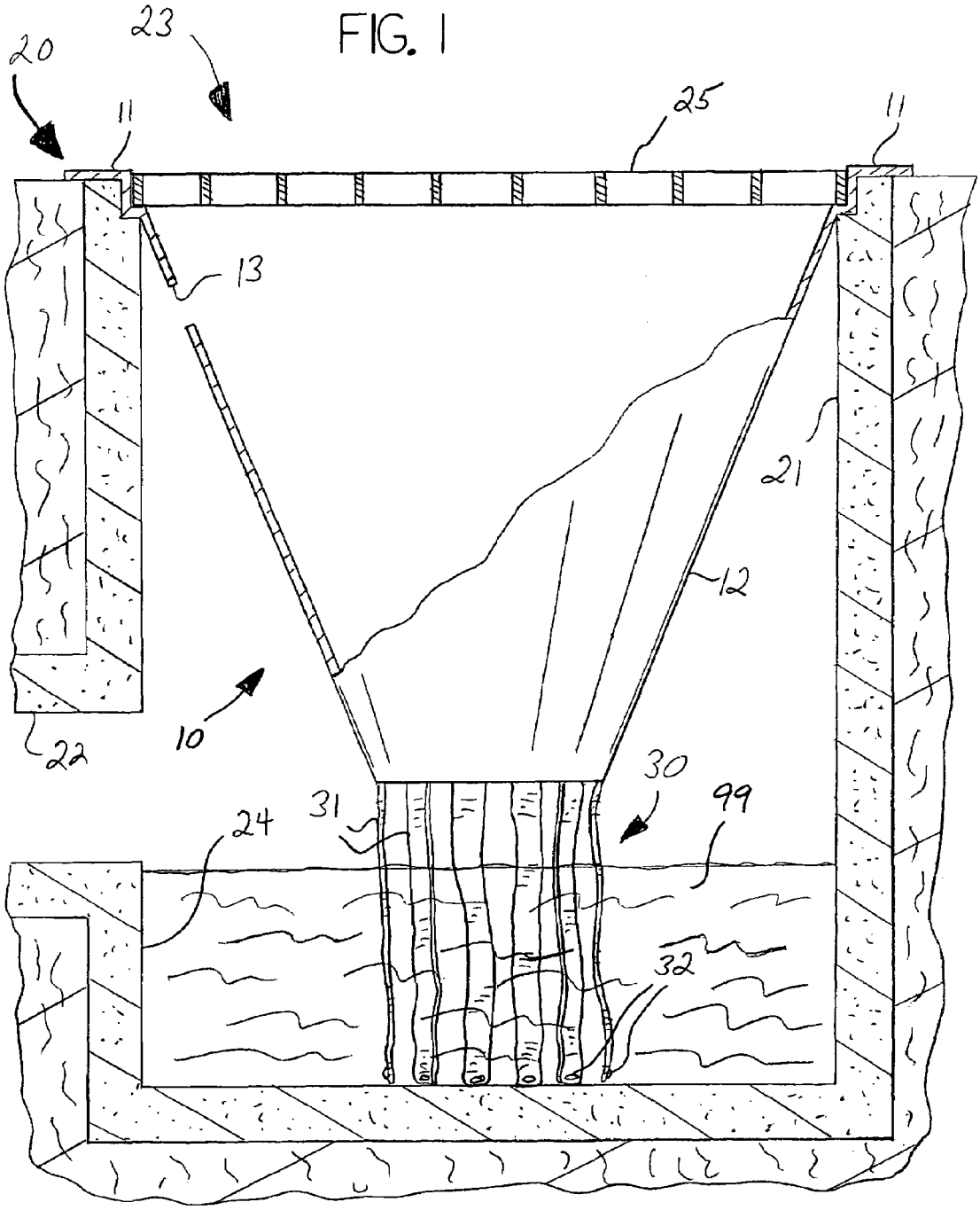
FIG. 1 shows a catch basin filter having depending strips carrying anti-microbial agents as disposed within a catch basin.

The invention is in general a catch basin filter means for severely reducing or eliminating bacterial contamination of storm water discharging from a storm water system into the environment, wherein the catch basin filter comprises elements that perform pass-through filtration of storm water run-off and elements that remain in contact with water resident in catch basin sumps. The term catch basin filter shall be taken herein to include a filter means disposed within a component of a storm water system that has an opening to receive storm water in a downward flow path and an associated sump or reservoir area that retains a quantity of water over time before it is flushed through the conduit system, such as for example surface inlets or curb inlets, and to a lesser degree underground filtration or detention storage vaults or chambers.

Storm water systems are well known and extremely common, typically consisting of large of numbers of storm drains 20 located in roadways, curbs, large paved areas such as parking lots, drainage ditches and the like. The storm drains 20 allow the storm water to fall through surface openings 23, usually covered by grates 25, and into structures known as catch basins 21. Outlet conduits 22 are connected to the catch basins 21 to transport the storm water to discharge points where the storm water is returned to the environment. A storm water system is a vast network, and there are numerous components or areas that act as reservoirs or sumps, either intentionally or unintentionally, where storm water remains resident within the system for extended periods of time, or at least until flushed out by a subsequent storm event. Sumps 24 are provided in the catch basins 21 to allow larger solids or other matter to settle, and are created in typical manner simply by connecting the outlet conduits 22 several inches or more above the bottom of the catch basin 20.

Because the water 99 often remains in these sumps 24 for extended periods of time between storm events, and because the sumps 24 will not necessarily be completely flushed upon subsequent storm events, the water 99 retained in the sumps 24 is prime for bacterial growth. This can result in an extremely high bacterial concentration in the discharge water when flushing of the storm system occurs.

The invention solves this problem by providing a combination filtration and anti-microbial member, referred to generally herein as a catch basin filter 10, that has elements positioned within the sump area 24 of the catch basin 21. The combination filtration and anti-microbial member 10 is both a pass-through filter for inflowing storm water and a resident treatment means for standing water 99. While the filter material may comprise many suitable materials that are known to be effective in removing particulate and other solid matter from flowing water, it is most preferable that the filter material also acts as an effective means to adsorb hydrocarbon and liquid organic contaminants, as the presence of these components in discharge water is also undesirable. Many known polymers, for example and not to be limiting, such as polypropylenes or polyesters exhibit this property. The filter material may also be of a type to remove heavy metals, phosphates, nitrates, etc., and multiple material layers may be utilized to target specific contaminants.

The catch basin filter 10 further comprises an anti-microbial agent. The anti-microbial agent may be any of many suitable compositions, such as for example but not limited to an organosilane antimicrobial agent as disclosed in U.S. Pat. No. 5,954,869, the disclosure of which is incorporated herein by reference. The anti-microbial agent is in known manner, such as disclosed in the above referenced patent, suitably bonded, adhered, grafted, impregnated or otherwise joined to the filter material itself, or the anti-microbial agent may be of solid form or suitably bonded, adhered, grafted, impregnated or otherwise joined to other carrier means that are then attached to, retained by or contained within pockets formed in the filter material. The term anti-microbial is meant herein to include any compound, product, composition, article, etc., that reduces the growth and proliferation of microbial organisms, including but not limited to bacteria, viruses, protozoa, molds and the like.

In a preferred embodiment, the catch basin filter 10 comprises securing means for retaining the catch basin filter 10 on or in the upper portion of the storm drain 20, such as a sheet member or flaps 11 that are held in place by the weight of the storm grate 25, as shown in FIG. 1. Alternatively, the catch basin filter 10 may be temporarily affixed within the storm drain 20 using frames, ropes, straps, hooks or the like, or may be retained within a filter box, or may be mounted to the wall of the catch basin 21 by various means. As shown in the drawings, a relatively large central opening is provided in the upper sheet member 11 or equivalent securing means such that storm water passes through this opening into the open top of a filtration bag or sack 12 that is joined to and depends from the sheet member 11. The filtration bag 12 is sealed or closed on the bottom such that storm water exits the filtration bag 12 by passing through its walls. Overflow openings or ports 13 may be provided in the upper portion of the filtration bag 12 to accommodate extremely high flow rates in known manner. The storm water is filtered as it passes through the filtration bag 12 to remove particulates and other undesirable matter. Examples of a catch basin filter illustrating these structural components is shown in U.S. Pat. No. 5,372,714 and in U.S. Pat. No. 5,575,925, the disclosure of both being incorporated herein by reference. Preferably, as mentioned above, the filter material is of the type that also removes hydrocarbons and organic liquids from the water flow. Likewise, the composition of the filter material can be chosen from materials known to selectively remove other contaminants, such as heavy metals, phosphates, nitrates, etc. In addition, although not essential for the efficacy of the invention, it is most preferred that anti-microbial agents be incorporated into the filtration bag 12 itself such that some of the microbes in the storm water are destroyed during pass-through filtration, and further such that growth of mold and like is precluded from blocking the interstitial openings of the filtration bag 12.

One or more anti-microbial carrier members 30 are connected to the filtration bag 12 or its securing means, whereby at least a portion of the anti-microbial carrier members 30 extend into or reside in the sump area 24 of the catch basin 21, the sump area 24 being defined to be the area of the catch basin 21 below the lowest outlet conduit 22, such that storm water 99 remains resident within the sump 24 between storm events. An anti-microbial agent is adhered to, combined with, or impregnated in the material composing the anti-microbial carrier members 30, or disposed as blocks, granules, beads or the like retained by pockets in the anti-microbial carrier members 30, or otherwise joined to or retained by the anti-microbial carrier members 30. Most preferably, the anti-microbial agent is permanently adhered to or retained by the anti-microbial carrier members 30, such that the anti-microbial agent does not disperse into or contaminant the resident water 99, but instead direct contact by bacteria and the like with the anti-microbial carrier members 30 is required for destruction of the bacteria and other organisms.

While the size and configuration of the anti-microbial carrier members 30 may vary greatly and no single size or configuration is required for efficacy, maximizing the surface area of the anti-microbial carrier members 30 and maximizing the amount of interstitial spaces within the material of composition is beneficial. In a preferred embodiment as shown in FIG. 1, the anti-microbial carrier members 30 comprise a plurality of strips or finger members 31 depending from the filtration bag 12, the depending strips 31 being of sufficient length to reach to or near the bottom of the catch basin sump 24. The strips 31 may be provided with weights 32 such that the ends of the strips 31 reside on the catch basin bottom rather than floating on top of the resident water 99 if the strips 31 are inherently buoyant. Preferably the strips 14 are composed of the same filtration material as the filtration bag 13, but the strips 14 may be of any material suitable to act as a matrix or carrier for the anti-microbial agent, including solid materials, foams, fabrics, sponges, etc. The distal ends of the strips 31 may be connected to each other flexibly or rigidly, such as with ropes, chains, rods or the like, so as to maintain a desired configuration, and may be secured to components of the catch basin 21 to prevent their being drawn into or blocking the outlet conduit 22. The anti-microbial carrier members 30 may be provided in any configuration, such as gapped as shown, edge-to-edge, overlapping, etc., may be provided as sheet members, may be slit in multiple directions such as to create a feathered effect, or may be perforated or otherwise configured to define additional flow paths for the bacteria containing water 99 to contact the anti-microbial agent.

As shown, the strip members 31 remain positioned in the water 99 captured within the catch basin sump 24 such that the extended time of exposure enables the anti-microbial agent to eradicate or severely reduce the microbial concentration in between storm events. The filtration and anti-microbial catch basin filter 10 is left in the catch basin 20 until its anti-microbial effectiveness becomes diminished or until the filtration bag 12 is filled with particulates, at which time it is cleaned and replaced or a new catch basin filter 10 is substituted. The presence of the anti-microbial agent also prolongs the effective life of the filter media itself, since growth of bacteria, mold or other microbial species on the filter media that may interfere with the filtering effectiveness is precluded.

Figure 2:
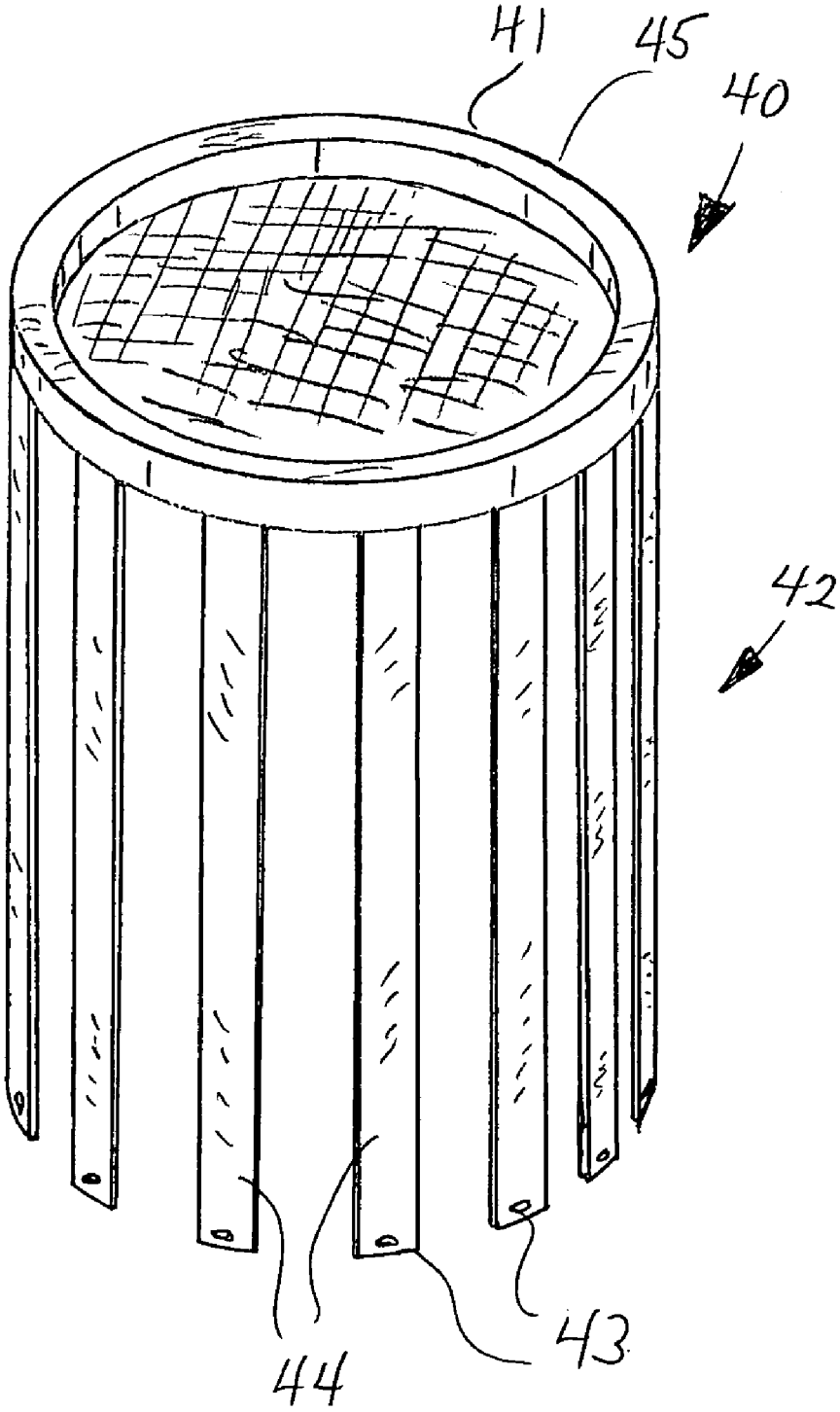
FIG. 2 is an alternative embodiment of the invention, showing the catch basin filter having a floating collar member.

In an alternative embodiment shown in FIG. 2, the invention is not positioned or secured so as to hang within the catch basin 21, but is instead a floating catch basin filter and anti-microbial device 40 that comprises floatation means 41, such as a collar member comprising a buoyant material, air chambers or the like, and having a plurality of anti-microbial carrier members 42, such as elongated fingers or strip members 44 depending therefrom. If necessary, weights 43 may be attached to maintain the ends of the strips 44 at the bottom of the catch basin sump 24. The filter 40 is sized or tethered such that it remains positioned in the catch basin 21 at the optimum receiving location, such that water falling into the catch basin 21 passes through the center of the floatation member 41, which has a sheet of filtration material 45 stretched across or hanging in sack-like manner therefrom such that the falling water passes directly through the filtration material 45. Preferably the configuration of the floatation means 41 corresponds to the configuration of the catch basin 21, such that for a cylindrical catch basin 21 an annular collar member 41 is utilized, but for a rectangular catch basin 21 a rectangular collar member 41 is used. As before, it is most preferred that the material of composition be of the type that removes hydrocarbons, organic liquids and other contaminants from the storm water.

It is understood and anticipated that equivalents and substitutions for certain elements described herein may be obvious to those skilled in the art, and therefore the true scope and definition of the invention is to be as set forth in the following claims.

We claim:

1. The combination of a storm water catch basin and a pass-through filter for filtering storm water passing through said catch basin, said catch basin having a sump that retains storm water in between storm events, said filter comprising at least one anti-microbial carrier member disposed within said sump and carrying an anti-microbial agent that is positioned within said sump whereby bacteria in said retained storm water is destroyed, and wherein said at least one anti-microbial carrier member comprises a plurality of depending strip members.

2. The combination of claim 1, wherein said anti-microbial agent is adhered to said at least one anti-microbial carrier.

3. The combination of claim 1, wherein said anti-microbial agent is retained within said at least one anti-microbial carrier.

4. The combination of claim 1, said filter further comprising a filtration bag whereby storm water is filtered as said storm water passes through said filtration bag.

5. The combination of claim 4, further comprising means to secure said filtration bag within said catch basin.

6. The combination of claim 1, wherein said filter is composed of a material that filters hydrocarbons.

7. The combination of claim 1, wherein said at least one anti-microbial carrier member is composed of a material that filters hydrocarbons.

8. The combination of claim 1, wherein said filter floats.

9. A storm water catch basin filter that treats flowing storm water and non-flowing resident storm water, said catch basin filter comprising pass-through filtering material that filters flowing storm water, and anti-microbial carrier members comprising an anti-microbial agent that treats non-flowing resident storm water by destroying bacteria wherein said pass-through filtering material comprises a bag and wherein said anti-microbial carrier members comprise a plurality of strip members and are connected to said bag.

10. The filter of claim 9, wherein said anti-microbial agent is adhered to said anti-microbial carrier members.

11. The filter of claim 9, wherein said anti-microbial agent is retained within said anti-microbial carrier members.

12. The filter of claim 9, wherein said filter is composed of a material that filters hydrocarbons.

13. The filter of claim 9, wherein said anti-microbial carrier members are composed of a material that filters hydrocarbons.

14. The filter of claim 9, wherein said filter floats.

15. A storm water catch basin filtration and anti-microbial device adapted for use within a storm water catch basin, said catch basin comprising a sump that retains storm water, said device comprising:

a filtration bag composed of a filter material, whereby storm water is filtered as said storm water passes through said filter material; and at least one anti-microbial carrier member connected so as to depend from said bag and comprising an anti-microbial agent, wherein said at least one carrier member is disposed so as to contact storm water previously filtered by said filtration bag and retained within said sump such that bacteria within said retained storm water is destroyed, and wherein said at least one anti-microbial carrier member comprises a plurality of strip members.

16. The device of claim 15, wherein said at least one anti-microbial carrier member is composed of a material that filters hydrocarbons.

17. The device of claim 15, wherein said filtration bag is composed of a material that filters hydrocarbons.

18. The combination of a storm water catch basin and a pass-through filter for filtering storm water passing through said catch basin, said catch basin having a sump that retains storm water in between storm events, said filter comprising at least one anti-microbial carrier member disposed within said sump carrying an anti-microbial agent that is positioned within said sump whereby bacteria in said retained storm water is destroyed, and further comprising weights attached to said at least one anti-microbial carrier member.

19. The combination of claim 18, wherein said anti-microbial agent is adhered to said at least one anti-microbial carrier.

20. The combination of claim 18, wherein said anti-microbial agent is retained within said at least one anti-microbial carrier.

21. The combination of claim 18, said filter further comprising a filtration bag whereby storm water is filtered as said storm water passes through said filtration bag.

22. The combination of claim 21, further comprising means to secure said filtration bag within said catch basin.

23. A storm water catch basin filtration and anti-microbial device adapted for use within a storm water catch basin, said catch basin comprising a sump that retains storm water, said device comprising:

a filtration bag composed of a filter material, whereby storm water is filtered as said storm water passes through said filter material; and at least one anti-microbial carrier member connected so as to depend from said bag and comprising an anti-microbial agent, wherein said at least one carrier member is disposed so as to contact storm water previously filtered by said filtration bag and retained within said sump such that bacteria within said retained storm water is destroyed, and further comprising weights attached to said at least one anti-microbial carrier member.

24. The device of claim 23, wherein said at least one anti-microbial carrier member is composed of a material that filters hydrocarbons.

25. The device of claim 23, wherein said filtration bag is composed of a material that filters hydrocarbons.

* * * * *